US006032035A

United States Patent [19]

Webster et al.

[11] Patent Number: 6,032,035

[45] Date of Patent: Feb. 29, 2000

[54] EMERGENCY RESPONSE SYSTEM

[75] Inventors: Robert K. Webster, Nepean; André J. Danis, Carleton Place; J. Raymond Whitbread, Ottawa; Réal Dufour, Gatineau, all of Canada

[73] Assignee: Elcombe Systems Limited, Kanata, Canada

[21] Appl. No.: 08/859,714

[22] Filed: May 21, 1997

[51] Int. Cl.[7] ..... G08B 25/00

[52] U.S. Cl. ..... 455/404; 455/403; 379/37

[58] Field of Search ..... 455/404, 567, 455/423, 424, 425, 67.1, 67.4; 379/37, 39, 40, 41, 42; 340/539, 571, 572

[56] References Cited

U.S. PATENT DOCUMENTS

| | | | |
|---|---|---|---|
| 4,850,036 | 7/1989 | Smith | 455/179 |
| 5,155,469 | 10/1992 | Hartmann et al. | 340/539 |
| 5,305,370 | 4/1994 | Kearns et al. | 379/45 |
| 5,337,342 | 8/1994 | Kruger et al. | 379/40 |
| 5,408,496 | 4/1995 | Ritz et al. | 375/202 |
| 5,416,695 | 5/1995 | Stutman et al. . | |

FOREIGN PATENT DOCUMENTS

| | | |
|---|---|---|
| 2051 444A | 4/1980 | United Kingdom . |
| 2223869A | 4/1990 | United Kingdom . |
| 2312066A | 10/1997 | United Kingdom . |
| WO80/00630 | 4/1980 | WIPO . |
| WO97/22940 | 6/1997 | WIPO . |

*Primary Examiner*—Thanh Cong Le
*Assistant Examiner*—Pablo N. Tran
*Attorney, Agent, or Firm*—Marks & Clerk

[57] ABSTRACT

A portable transmitter unit for an emergency response system is provided with a receiver to detect, decode and dynamically store location codes transmitted by strategically placed high frequency AM transmitters. The location code is attached to the stored identity code assigned each portable unit. The combined code is transmitted via a radio signal to an emergency response station upon activation of a switch on the unit by a user requiring assistance.

10 Claims, 3 Drawing Sheets

EMERGENCY RESPONSE SYSTEM

FIELD OF THE INVENTION

This invention relates to an emergency response or alerting system and more particularly to such a system wherein both the identity and location of an individual requiring emergency assistance is made available to a monitoring station.

BACKGROUND

A typical emergency response system comprises a telephone connected to a private or public telephone network where the telephone also houses a radio receiver. A person subscribing to this system may wear a portable transmitter, which during an emergency, can be made to transmit coded information to the radio receiver within the telephone. The information is a unique identity code to which that particular phone has been programmed to respond. The telephone then automatically dials a supervising service which provides the identity of the caller and if so equipped establishes a two-way hands-free communication. U.S. Pat. No. 5,337,342 which issued Aug. 9, 1994 to Kruger et al describes such a system.

The automatic dialing can also be initiated by depressing an emergency button on the telephone, but this assumes that the person involved happens to be close to the phone, whereas the use of radio signaling allows the person to activate the system remotely at distances of up to 200 feet.

This system can be used in the home, community living establishments, retirement housing, assistant living buildings, etc. Due to the use of codes many phones can be used within the same facility without mutual interference.

Many facilities which use this type of system are large, comprising several multi-story buildings having common areas such as dining rooms, libraries, games and music rooms etc. As is known, such facilities also typically have long corridors. Further, residents of such facilities tend to be elderly although they may be quite mobile and able to travel freely throughout the premises.

Due to the limited range of the radio communication, which is limited by regulation, and the fact that propagation of radio waves inside a building is damped by walls, floors and ceilings, people may not be able to trigger their own telephone from where they happened to be, and excessive range can also mislead the supervisor as to the true user's location.

In an attempt to solve this problem common receivers (ones which recognize all coded transmissions and hence respond to all system users) can be strategically placed so as to cover the whole facility. The problem occurs that to provide good coverage the reception areas of the receiver will overlap, since radio range is not a precisely determined system parameter. This may misdirect the supervising personnel, for instance tricking them into thinking a caller is in a different building or on a different floor. This may also lead to several calls being activated simultaneously which will unnecessarily occupy the supervising system. The nature of radio propagation is such that it can make it easier to trigger a receiver on the top floor of an adjacent building than to trigger a receiver down a long corridor in the same building and on the same floor as the caller. The problems tend to make simple solutions to the above problem inaccurate and expensive.

SUMMARY OF THE INVENTION

It is an object of the present invention to provide an emergency response system wherein the activation of a transmitter unit carried by the user provides to a monitoring station a coded signal representing, uniquely, the identity of the user and the user's location.

Therefore, in accordance with a first aspect of the present invention there is provided in a portable transmitter unit for an emergency alerting system, the portable transmitter unit having memory means for storing a unique unit identity code, processing means for selectively retrieving the identity code from the memory and a transmitter for selectively transmitting data including the identity code, having detector means for receiving and interpreting coded location information and accessing means for accessing the processing means to attach the coded location information to the identity code.

In a preferred embodiment of the invention the portable transmitter/receiver unit has means to permit a user of the unit to conduct voice communication with a remote terminal.

The portable transmitter/receiver unit also has means to compare a newly received coded location information with the coded location information stored in memory, and if the new coded location information is different to replace the code stored in the memory with the new code.

In accordance with a second aspect of the present invention there is provided a transmitter for providing location code to a portable, emergency transmitter/receiver unit, the transmitter having memory means to store a predetermined location code and transmitting means to periodically transmit the location code.

In a preferred embodiment of the invention the location code is transmitted at one of the industrial, scientific and medical (ISM) frequency bands using pseudo-random, spread-spectrum techniques.

In accordance with a further aspect of the present invention there is provided a local receiver for receiving coded information from a portable transmitter/receiver of an emergency alerting system. The coded information includes an identity code respecting the portable transmitter/receiver from which the code is received and a location code representing the location of the portable transmitter/receiver.

In accordance with yet a further aspect of the present invention there is provided an emergency monitoring and alerting system comprising a transmitter having a stored location code representing a location of the transmitter and transmitting means for periodically transmitting the code. The system also includes a portable transmitter/receiver unit for use by a user of the system, the transmitter/receiver having a receiver to detect, decode and store the location code transmitted thereto by the transmitter, processing means including storing means to store an identity code respecting the transmitter/receiver unit, the processing means also having means to attach the location code to the identity code and to transmit the combined code in response to a command by the user. The system further includes a local receiver for receiving the combined code and determining the identity and the location of the user.

In a preferred embodiment of this aspect of the invention, the local receiver has transmission means to forward the identity and location code to a supervising station. The local receiver may also have discrimination means to assess the location code information received from the portable transmitter/receiver units and to forward to the supervising station only the coded information which originates within a certain predefined area.

BRIEF DESCRIPTION OF THE DRAWINGS

The invention will now be described in greater detail with reference to the attached drawings wherein.

DETAILED DESCRIPTION OF THE INVENTION

Figure 1:
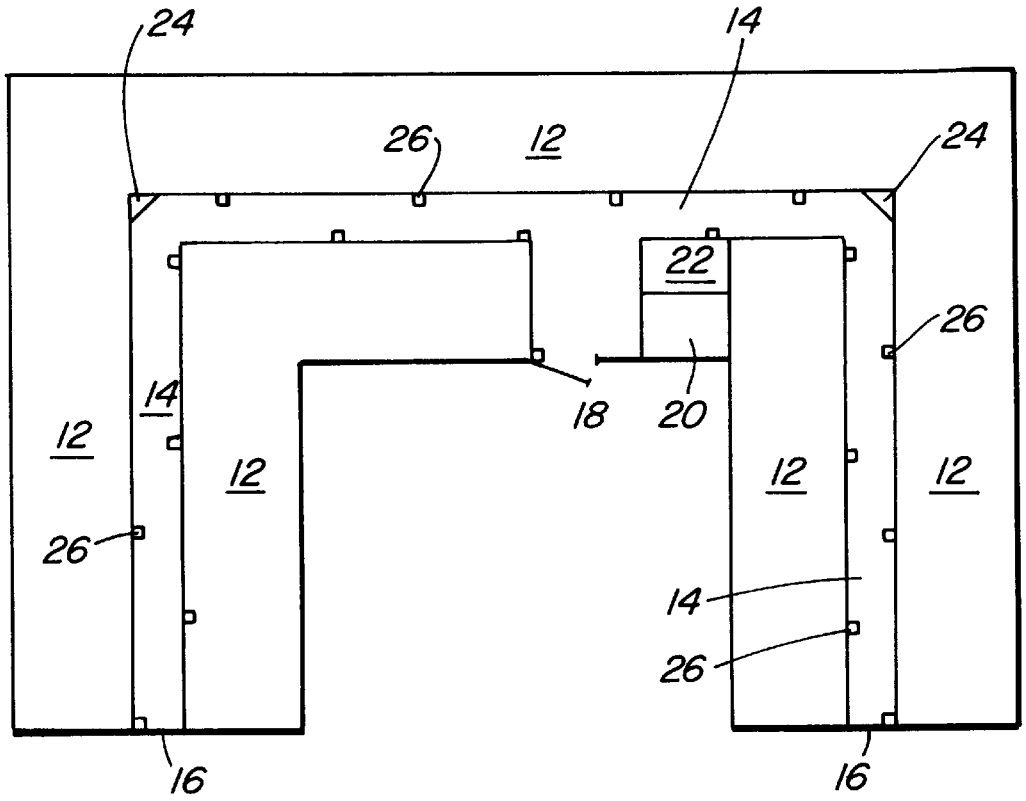
FIG. 1 is a circuit block diagram of the system according to the present invention.

FIG. 1 represents a common living facility such as a nursing home, retirement home, hospital, etc. for which the emergency response system of the present invention will find application. FIG. 1 illustrates only a single level but it is to be understood that the system according to the invention is particularly suitable for multi-leveled buildings and complexes comprising several adjacent buildings.

In FIG. 1 the areas 12 will include rooms or suites occupied by the residents. Access to the rooms is by corridor 14. There may, of course, be exit doors as at 16 and a main entrance 18. The building may also include reception and monitoring area 20 and elevator 22 in the event of a multi-leveled structure.

Many residents of a facility as shown in FIG. 1 may have health-related conditions which will require that they be provided immediate assistance in emergency situations. These residents will subscribe to and/or be provided with a portable transmitter unit which may for example be a pendant worn around their neck. The portable transmitter may, of course, have a different configuration and be carried or worn elsewhere by them. As discussed previously, such portable transmitters are used to transmit by a radio signal to a local or common receiver which in turn notifies a monitoring station where a trained specialist is located to provide immediate attention. It is also contemplated that the monitoring station will be connected to the public switched telephone network or a PBX switch whereby the user of the transmitter will be able to communicate via hands-free voice communication to a designated recipient of the emergency call.

As discussed previously such radio connections are not precise and the exact location of the person requiring the emergency assistance may not be immediately known. In the case of such emergency situations response time is critical and, the present invention provides a further refinement to the system which ensures that the precise location of the user of the transmitter can be determined.

Returning again to FIG. 1 the present invention provides at strategic locations such as locations 24 a common or local receiver which is able to receive the radio transmission from a user of the system while the user is located in corridor 14 or in one of the rooms in areas 12.

Local receivers 24 are connected to central monitoring station 20 such that emergency calls received therein can be further processed. As will be apparent from FIG. 1 an emergency signal received at one of the local receivers positioned in a corner will not be able to distinguish as to which of the adjoining corridors the signal originated. As previously discussed, the radio signal may also have originated in an adjoining building or in a floor above or below the level on which the emergency occurred.

In accordance with the present invention a plurality of transmitters 26 are located along the corridor and at other strategic locations such as adjacent exits 16, main entrance 18 and elevator 22. Transmitters 26 operate at a high frequency which preferably is one of the industrial, scientific and medical (ISM) frequency bands which are 902–928 MHz; 2.4 to 2.4835 GHz; and 5.725 to 5.850 GHz. These bands do not require a license but certain conditions, which will be discussed later, must be satisfied. For the sake of the present description the transmitter will be said to operate at a frequency of 900 MHz.

Figure 4:
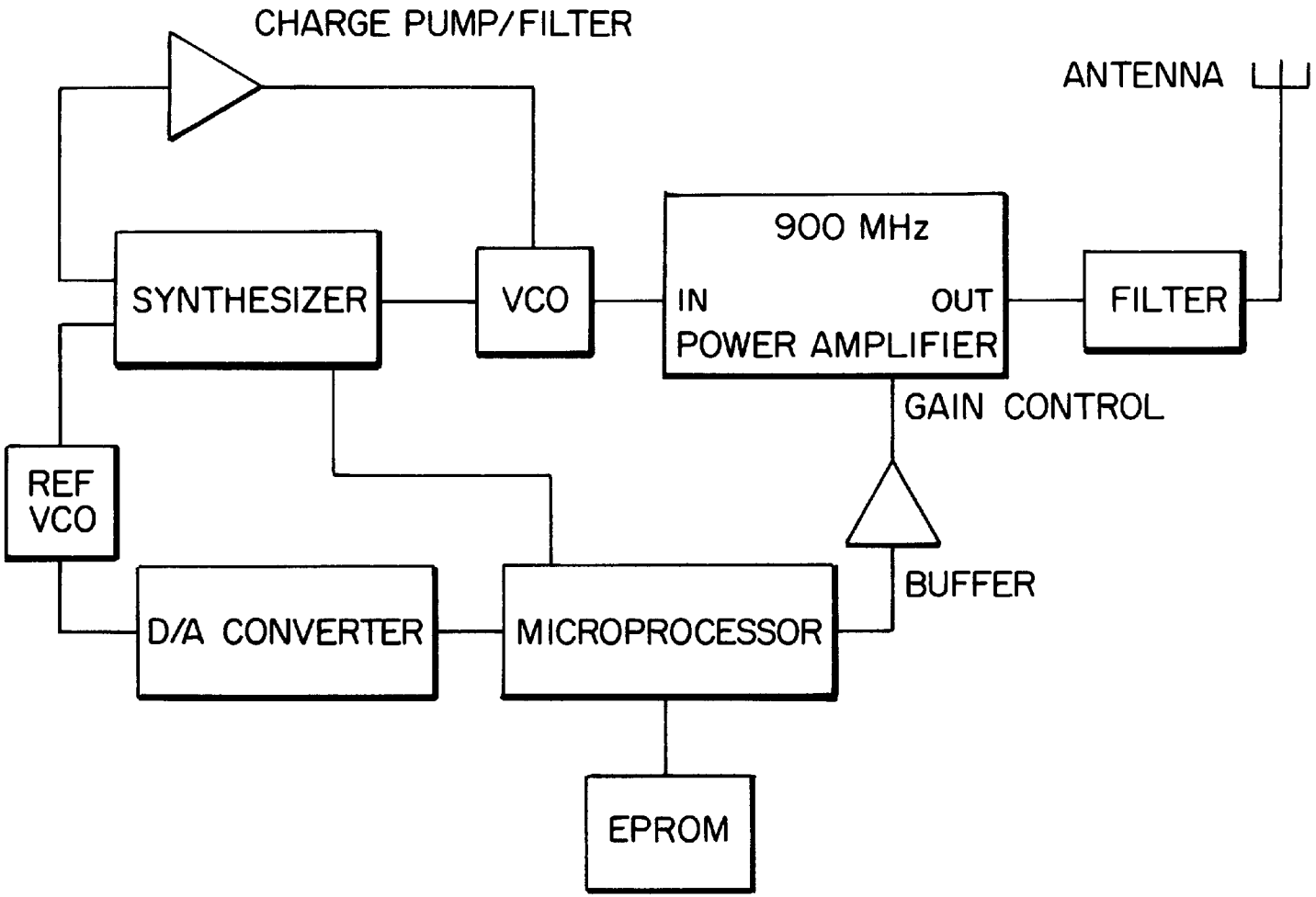
FIG. 4 is a block diagram of the spread spectrum AM transmitter.

These transmitters continually transmit an amplitude modulated signal comprising a code representing the location of that transmitter. These transmit at moderate power so that the range is only a few meters and there is no overlap between units. This allows the transmitters to be placed quite close together, 10 m as an example, if greater accuracy of location is required. The zone or location code will be short such as 6 bits separated by a few milliseconds of space. As indicated previously, each transmitter 26 will continually transmit a code which is unique to that transmitter. A block diagram of an exemplary transmitter 26 is shown in FIG. 4.

Figure 2:
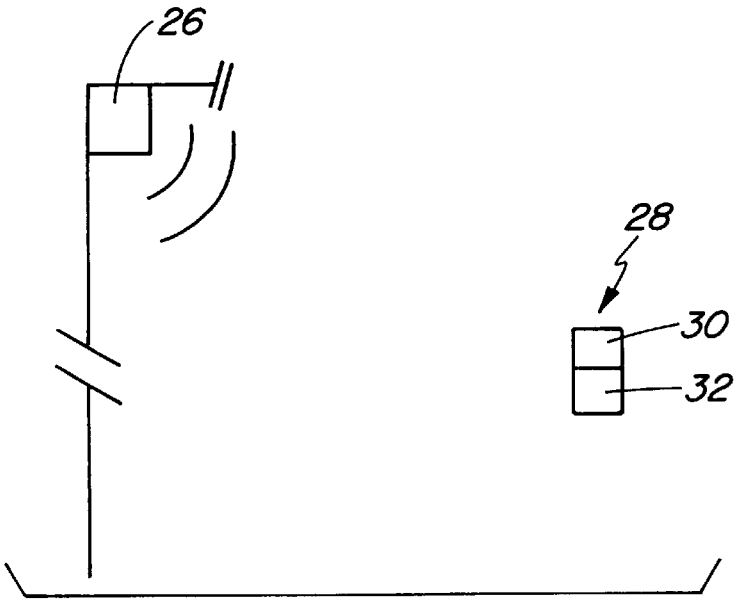
FIG. 2 is a block diagram of the transmitter and transmitter/receiver units.
Figure 3:
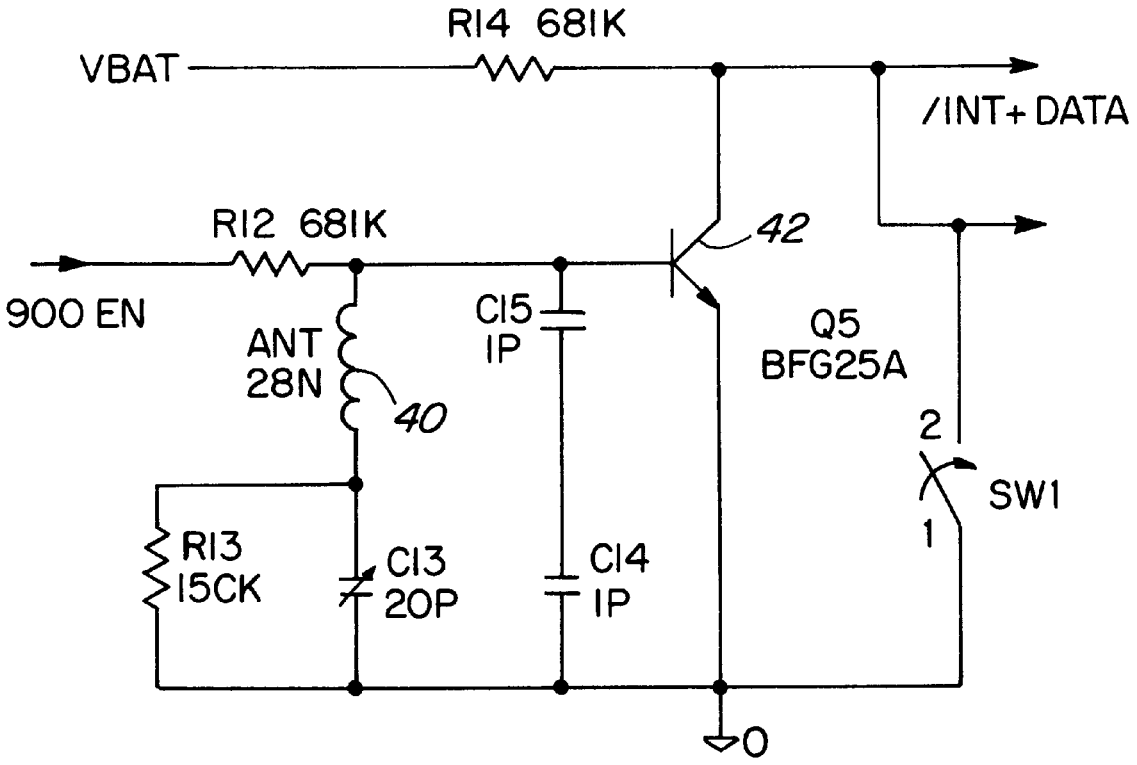
FIG. 3 is a circuit diagram of the detector circuit in the portable transmitter/receiver unit.

The portable transmitter unit carried by the user of the system, in accordance with the invention, is provided with a receiver operating at the same frequency as the transmitters 26. Thus, portable unit 28 as shown in FIG. 2 includes receiver 30 and transmitter 32. The amplitude modulation receiver 30, operating at 900 MHz uses a small loop antenna 40 and a single transistor detector 42 to both receive the far-off signal and demodulate it. The detector circuit is shown in FIG. 3. Because of the high frequency the receiver may be small and operates at a low current. The output of the receiver is connected to an input-output port of a microprocessor, not shown, which can read the state of that port and interpret the demodulated data. Thus, receiver 30 of portable unit 28 as it is carried within the transmitting range of a transmitter 26 receives the location code of the transmitter and records the code in the dynamic memory of the microprocessor. The individual carrying or wearing the portable unit 28 and traveling throughout the building along a corridor 14 will pass through the transmitting range of successive transmitters 26. As the individual passes through these ranges the location code stored within the dynamic memory is updated to always have the location code of the closest or most recently passed transmitter. Depending, of course, on the spacing of these transmitters the location of the user can be traced to within a few meters.

The microprocessor in the portable transmitter/receiver tests the port every 100 milliseconds or so for data presence. When this unit is in the vicinity of a 900 MHz transmitter it will see data which is in the form of a coded word representing that physical location. The data bits are then appended to the identity code which represents the particular portable transmitter/receiver unit.

In the event that the wearer of the portable unit is in need of assistance the emergency switch, push-button etc. is activated by the user and the portable unit identity code and the location code are transmitted via a radio signal to the nearest common or local receiver 24.

Receiver 24, in a preferred embodiment, is equipped with a microprocessor which examines the location code and determines whether the code is within a range of codes within a predefined zone i.e. same building and same floor. If it is within the range of codes the emergency message is immediately forwarded to the monitoring station for attention. If the microprocessor determines that the call originated from another floor, another building etc. it will not forward the emergency message and thereby limits the calls being made to the monitoring station.

A successful transmission between a 900 MHz transmitter and the portable receiver is recognized by the reception of a number of identical words which avoids the simulation of data by noise or other extraneous receptions. If the data is bad the processor shuts off the receiver so as to conserve power. If the data looks good it is handled as above and the processor ceases to look for data for a prescribed length of time such as 1 minute so that if a portable unit is within the field of a 900 MHz transmitter for any length of time it is not needlessly leaving the receiver on wasting power. The off time, controlled by software, may be programmed according to system needs.

The receiver 30 consumes of the order of 10 microamps when it is turned on by the processor and is receiving data and 5 microamps if not receiving. The duty cycle is about 20 to 1 being questioned every 100 milliseconds and taking approximately 5 milliseconds to recognize "no data". Thus the average consumption is 0.25 microamps continuous which is one tenth of the allowance for a 5-year battery life of a sealed portable transmitter/receiver unit. This means that the common area location problem can be solved with minor additions to the portable device without affecting battery life and without complicating communication between common receivers, i.e. the solution leads to a cost-effective and accurate system.

Since the portable transmitter/receiver unit is capable of receiving data via the 900 MHz receiver, it is also capable of receiving its identity code. This allows the code to be changed by external means without tampering with the unit. This is done by recognizing the length of the data word being received and thereby allows portable units to be field programmable with no switches. As indicated previously a zone code will be short such as 6 bits separated by a few milliseconds of space. The identity code will, in a preferred embodiment, be 14 bits or more. The identity code is stored in three different places in the processor RAM and a voting/correction system of two out of three is used to avoid corrupt data. The basic reason for this approach is that in case of applications where the portable device is sealed and the identity code is stored in RAM it is best to avoid processor resets which corrupt RAM data. Thus soft memory errors can be corrected by the above process.

As described previously the selected frequency range is in one of the ISM frequency bands. For a reasonable range to be established between the transmitter, which may be wall or ceiling mounted, and the portable transmitter/receiver, which is ultra simple, the transmitter power must be of the order of 100 milliwatts. In the unlicensed 902–926 MHz band this requires that the transmission be spread-spectrum and pseudo-random in nature. There are two allowed methods: (a) direct sequence and (b) frequency hopping. In the present invention the frequency hopping method is used operating at 60 different frequencies spread over 15 MHz of the band in a semi-random fashion. Each frequency is dwelt upon for 100 milliseconds and the pattern is such that most of the 15 MHz is covered by 5 such dwell times. During each dwell the coded zone word and space is sent 5 times and it is estimated that 4 acceptable zone words must be received for a good transmission. This means that a receiver carried by a person walking by a transmitter will see 5 good words at a frequency from one end of the band to the other in ½ second. This is sufficient to be within range and out of a radio "hole". Holes are known as places of poor signal level due to the wave nature of the signal and multipath interference. This allows for the receiver to be imperfectly tuned as the transmitter effectively scans the band again keeping the 900 MHz receiver simple.

In the foregoing, radio signalling or RF is described as the method of signalling between the portable transmitter/receiver unit and the local receiver. It is within the scope of the invention, however, to utilize other signalling techniques such as infrared or by way of a network of user activated switches such as floor or mat switches.

Although specific embodiments of the invention have been described and illustrated it will be apparent to one skilled in the art that various changes can be made to these embodiments. It is to be understood that such changes are considered to be within the scope of the invention as set out in the appended claims.

We claim:

1. An emergency monitoring and alerting system comprising: a plurality of high frequency, amplitude modulation transmitters strategically placed within an area to be monitored each having a stored location code representing a specific location of said transmitter and transmitting means for transmitting said code via a high frequency am spread spectrum frequency hopping technique; a portable transmitter/receiver unit for use by a user of the system, said transmitter/receiver unit having a high frequency am receiver to periodically detect, decode and store said location code transmitted thereto by said transmitter; processing means including storage means to store a unique identity code respecting said transmitter/receiver unit, said processing means also having means to attach said location code to said identity code and to transmit the combined code in response to a command by said user, said transmitter/receiver unit having timing means to test for coded information on a periodic basis and to defer testing for a set interval upon receipt of said location code; and a local receiver for receiving said combined code and determining the identity and the location of said unit and if said code represents a location within a preset group of locations forwarding said data to a central monitoring station, otherwise ignoring said code.

2. An energy monitoring and alerting system as defined in claim 1 wherein said timing means defers testing for coded information for an of about one minute after coded information has been received.

3. A portable transmitter/receiver unit for an emergency alerting system comprising: memory means for storing an identity code which is unique to said unit; processing means for selectively retrieving said identity code from said memory means; transmitting means for transmitting data including said identity code upon activation of a switch on said unit; a high frequency, amplitude modulation (am) receiver having detector means for receiving and interpreting coded location information received via a high frequency am signal from one of a plurality of local high frequency am transmitters, said receiver testing for coded information on a periodic basis; and accessing means for accessing said processing means and attaching said coded location information to said identity code to be transmitted therewith, said detector means including means to selectively turn off said receiver for a preset interval upon receipt of said coded location information.

4. A portable transmitter/receiver unit as defined in claim 1 having means to compare new coded location information from another of said local transmitters with coded location information attached to said identity code and if said new coded location information is different to replace said code attached to said identity code.

5. A high frequency, amplitude modulation, (am) transmitter for providing a location code to a portable, emergency transmitter/receiver unit as defined in claim 1, said transmitter having memory means to store a predetermined location code and transmitting means to transmit said location code utilizing a pseudo-random, spread spectrum, frequency hopping transmission technique wherein the range of frequency selected covers a sub-range of 15 MHz of a 902 MHz to 928 MHz Industrial, Scientific and Medical (ISM) frequency band.

6. A portable transmitter/receiver unit as defined in claim 1 wherein said unique code assigned to said unit consists of a set number of data bits that is different than the number of bits comprising said coded location information and is transmitted to said unit through said high frequency am receiver.

7. A portable transmitter/receiver unit as defined in claim 1 wherein said receiver tests for coded information for an interval of 5 milliseconds and a period of 100 milliseconds.

8. A portable transmitter/receiver unit as defined in claim 6 wherein said unique code assigned to said unit is data word having at least 14 bits and said location code is a 6 bit word.

9. A portable transmitter/receiver unit as defined in claim 8 wherein said unique code assigned to said unit is stored in three separate locations in said memory means.

10. A local receiver for receiving coded information from a portable transmitter/receiver unit of an emergency alerting system, said coded information including an identity code respecting the portable transmitter/receiver unit from which the code is received and a location code representing an approximate location of said portable transmitter/receiver, said local receiver including processing means to evaluate said location code and if said code is within a set of predetermined codes said information is forwarded to a central control station otherwise it is ignored.

* * * * *